US009263004B1

(12) United States Patent
Brown

(10) Patent No.: US 9,263,004 B1
(45) Date of Patent: Feb. 16, 2016

(54) MUSICAL PERFORMANCE ASSEMBLY

(71) Applicant: Jessie Brown, Baton Rouge, LA (US)

(72) Inventor: Jessie Brown, Baton Rouge, LA (US)

( * ) Notice: Subject to any disclaimer, the term of this patent is extended or adjusted under 35 U.S.C. 154(b) by 0 days.

(21) Appl. No.: 14/723,123

(22) Filed: May 27, 2015

(51) Int. Cl.
*G10H 1/32* (2006.01)
*G10H 3/00* (2006.01)
*G10D 3/00* (2006.01)

(52) U.S. Cl.
CPC ..... *G10D 3/00* (2013.01)

(58) Field of Classification Search
CPC ..... G10D 3/00; G10H 1/342
USPC ..... 84/744
See application file for complete search history.

(56) References Cited

U.S. PATENT DOCUMENTS

| | | | | | |
|---|---|---|---|---|---|
| 3,555,166 | A * | 1/1971 | Gasser | 84/600 |
| 3,665,490 | A * | 5/1972 | Oskar | 381/366 |
| 4,794,838 | A * | 1/1989 | Corrigau, III | 84/600 |
| D325,742 | S * | 4/1992 | Phillips | D17/14 |
| 5,105,711 | A * | 4/1992 | Barnard | 84/744 |
| 5,121,668 | A * | 6/1992 | Segan et al. | 84/646 |
| 5,691,490 | A * | 11/1997 | Williams | 84/170 |
| 5,837,912 | A * | 11/1998 | Eagen | 84/267 |
| 6,111,179 | A | 8/2000 | Miller | |
| 6,696,632 | B2 | 2/2004 | Minakuchi et al. | |
| 6,800,797 | B2 | 10/2004 | Steiger, III | |
| D549,766 | S * | 8/2007 | Greenberg | D17/2 |
| 7,355,110 | B2 * | 4/2008 | Nash | 84/601 |
| 7,482,531 | B2 * | 1/2009 | Doering | 84/737 |
| 8,389,835 | B2 | 3/2013 | Findley et al. | |
| 8,847,051 | B2 * | 9/2014 | Hanks | 84/423 R |
| 2008/0156180 | A1 * | 7/2008 | Bagale | 84/743 |
| 2008/0184864 | A1 | 8/2008 | Holt et al. | |
| 2012/0297962 | A1 * | 11/2012 | O'Donnell et al. | 84/645 |
| 2013/0255474 | A1 | 10/2013 | Hanks | |
| 2015/0059561 | A1 * | 3/2015 | Mejia | 84/737 |

* cited by examiner

*Primary Examiner* — Jeffrey Donels

(57) ABSTRACT

A musical performance assembly includes a guitar that has a body and a neck. A control circuit is attached to the guitar and the control circuit is positioned within the body. A keyboard is attached to the guitar such that the keyboard may be manipulated in the convention of playing music. A first set of switches is attached to the guitar and each of the first set of switches is electrically coupled to the control circuit. A second set of switches is attached to the guitar and each of the second set of switches is electrically coupled to the control circuit. A microphone is attached to the guitar to record a voice. The microphone is electrically coupled to the control circuit. Each of the second set of switches is manipulated to actuate the control circuit such that the control circuit may modify a sound of the recorded voice.

9 Claims, 3 Drawing Sheets

MUSICAL PERFORMANCE ASSEMBLY

BACKGROUND OF THE DISCLOSURE

Field of the Disclosure

The disclosure relates to performance devices and more particularly pertains to a new performance device for allowing a voice to be recorded and modified for playback to accompany a guitar or keyboard.

SUMMARY OF THE DISCLOSURE

An embodiment of the disclosure meets the needs presented above by generally comprising a guitar that has a body and a neck. A control circuit is attached to the guitar and the control circuit is positioned within the body. A keyboard is attached to the guitar such that the keyboard may be manipulated in the convention of playing music. A first set of switches is attached to the guitar and each of the first set of switches is electrically coupled to the control circuit. A second set of switches is attached to the guitar and each of the second set of switches is electrically coupled to the control circuit. A microphone is attached to the guitar such that the microphone may record a voice. The microphone is electrically coupled to the control circuit. Each of the second set of switches is manipulated to actuate the control circuit such that the control circuit may modify a sound of the recorded voice.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
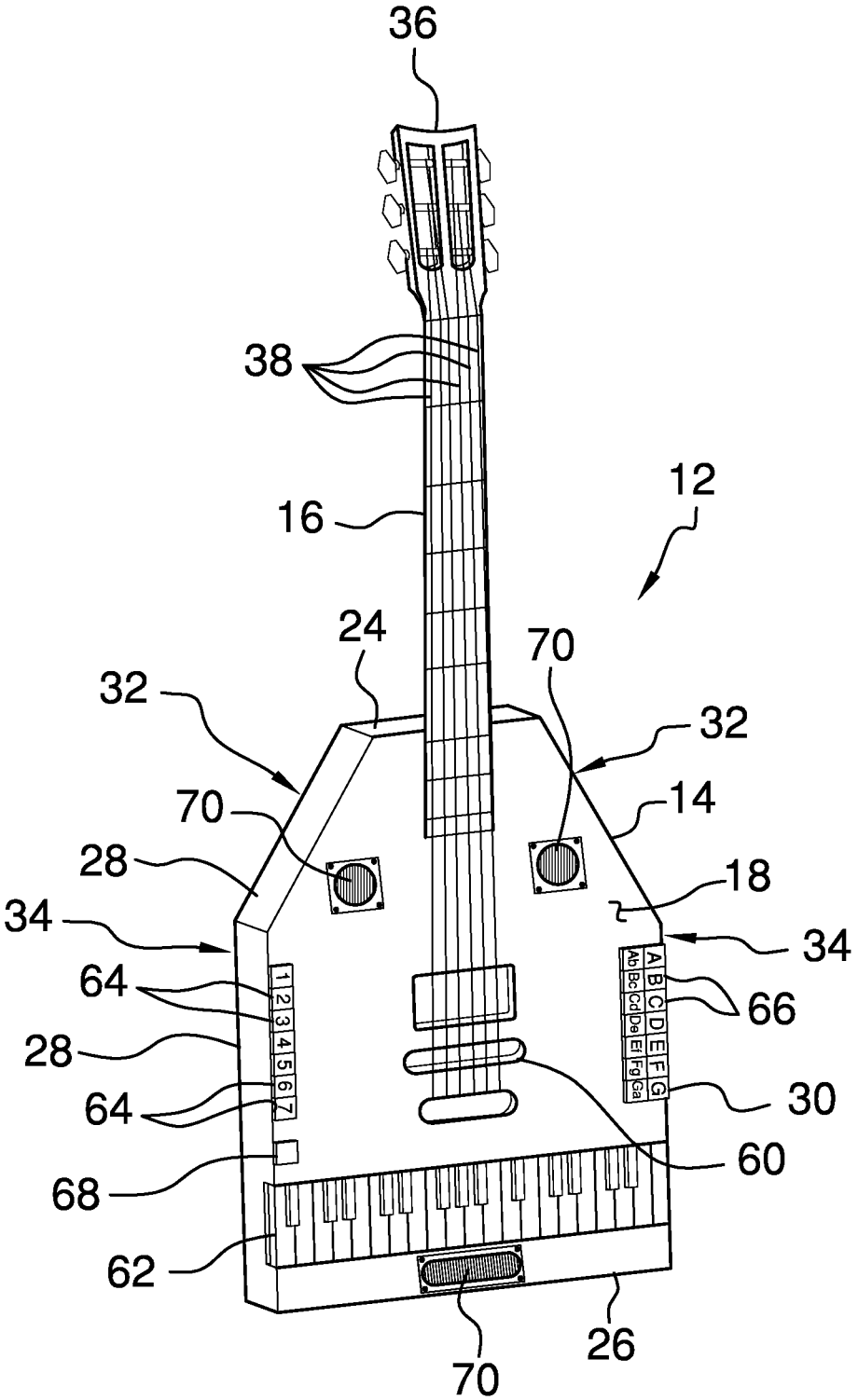
FIG. 1 is a perspective view of a musical performance assembly according to an embodiment of the disclosure.
Figure 2:
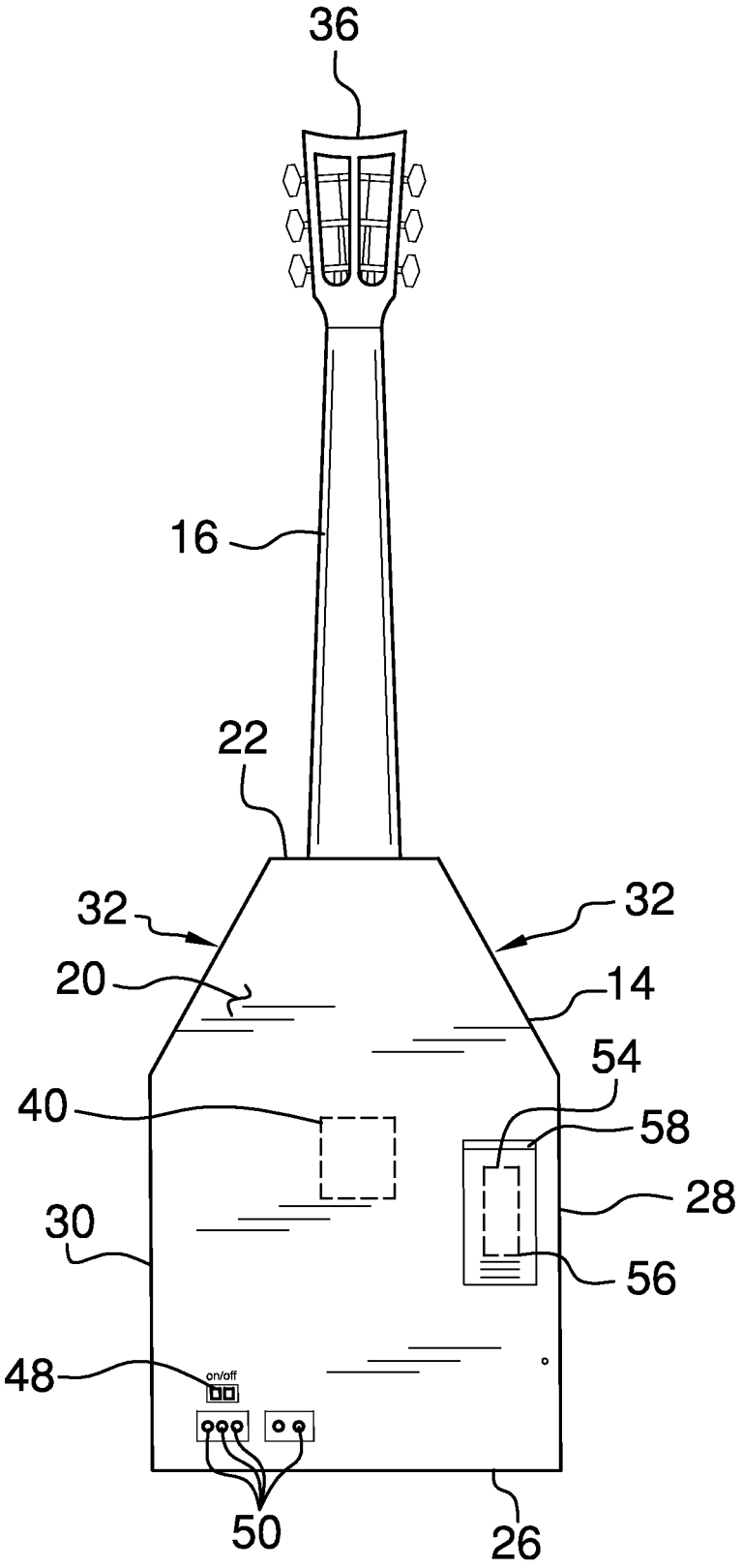
FIG. 2 is a back view of an embodiment of the disclosure.
Figure 3:
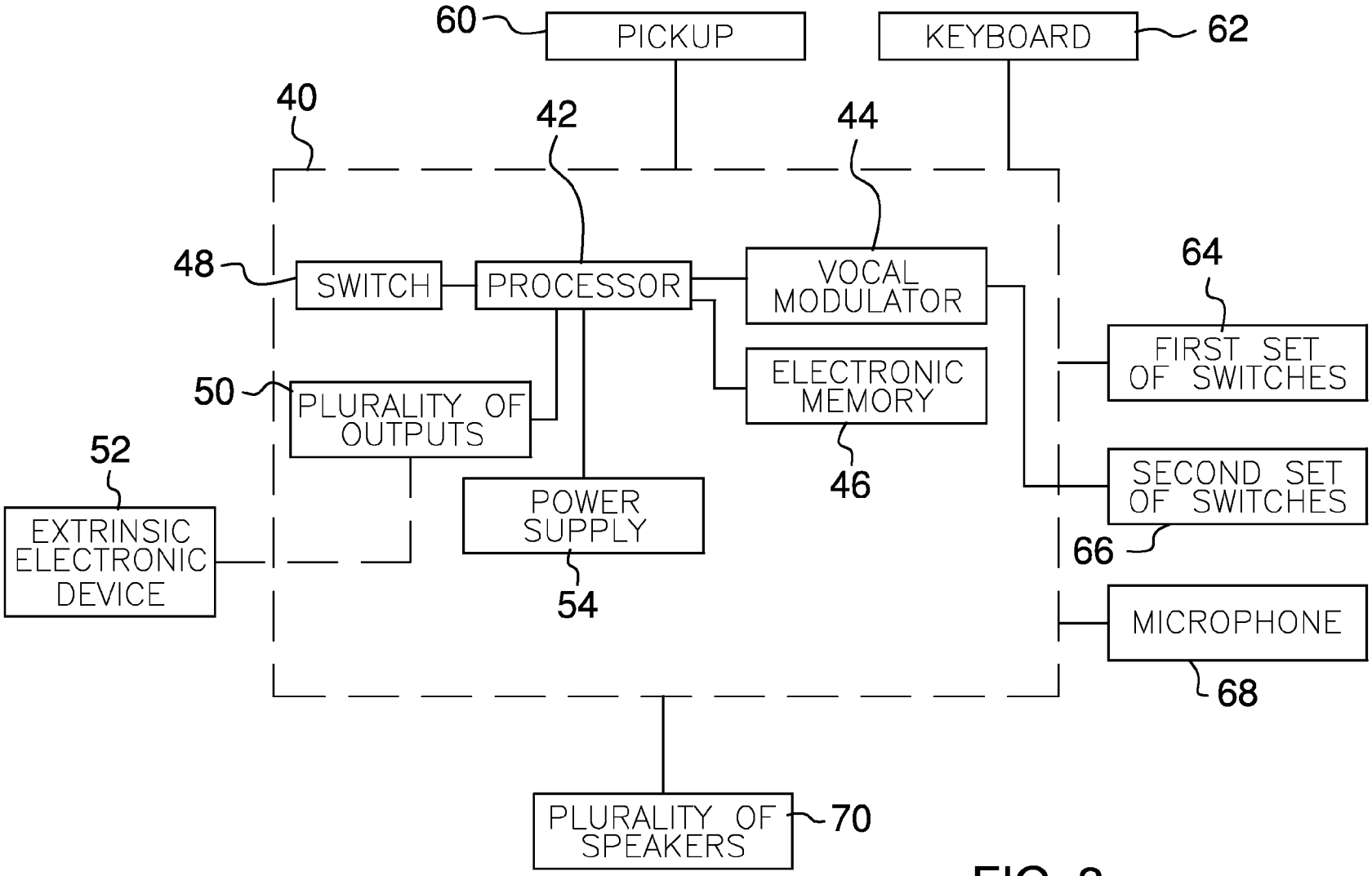
FIG. 3 is a schematic view of an embodiment of the disclosure.

With reference now to the drawings, and in particular to FIGS. 1 through 3 thereof, a new performance device embodying the principles and concepts of an embodiment of the disclosure and generally designated by the reference numeral 10 will be described.

As best illustrated in FIGS. 1 through 3, the musical performance assembly 10 generally comprises a guitar 12 that has a body 14 and a neck 16. The body 14 has a top surface 18, a back surface 20 and a peripheral edge 22 extending between the top surface 18 and the back surface 20. The peripheral edge 22 has a top side 24, a bottom side 26, a first lateral side

28 and a second lateral side 30. Each of the first lateral side 28 and the second lateral side 30 has an angled portion 32. The angled portion 32 of each of the first lateral side 28 and the second lateral side 30 angles inwardly between a point proximate a middle 34 of the body 14 and the top side 24.

The neck 16 extends away from the top side 24 and the neck 16 has a distal end 36 with respect to the body 14. The guitar 12 includes a plurality of strings 38 extending along the neck 16 and the top surface 18 of the body 14. Thus, the strings 38 may be manipulated in the convention of playing music on the guitar 12. The strings 38 may be guitar strings of any conventional design.

A control circuit 40 is attached to the guitar 12 and the control circuit 40 is positioned within the body 14. The control circuit 40 includes a processor 42 and a vocal modulator 44. The vocal modulator 44 is electrically coupled to the processor 42. The processor 44 may be an electronic processor or the like and the vocal modulator 44 may be an electronic vocal modulator or the like. The vocal modulator 44 may be capable of altering a wave form of a voice to include pitch, volume and other aural qualities of a voice. An electronic memory 46 is positioned within the guitar 12 and the electronic memory 46 is electrically coupled to the processor 42. The electronic memory 46 may comprise RAM memory or the like.

A switch 48 is coupled to the back surface 20 and the switch 48 is electrically coupled to the processor 44. A plurality of outputs 50 is provided and each of the outputs 50 is positioned on the back surface 20 of the guitar 12. Each of the outputs 50 is electrically coupled to the processor 42 and each of the outputs 50 may be electrically coupled to an extrinsic electrical device 52. The extrinsic electrical device 52 may comprise an amplifier or the like.

A power supply 54 is positioned within the body 14 and the power supply 54 is electrically coupled to the switch 48. The power supply 54 comprises at least one battery 56. A battery cover 58 is removably coupled to the back surface 20 of the body 14. The power supply 54 is positioned beneath the battery cover 58.

A pickup 60 is attached to the guitar 12 and the pickup 60 is positioned on the top surface 18 of the body 14. The pickup 60 is positioned beneath the strings 38 such that the pickup 60 converts vibration from the strings 38 into an electrical signal. The pickup 60 is electrically coupled to the control circuit 40 and the pickup 60 may comprise an electric guitar pickup of any conventional design.

A keyboard 62 is attached to the guitar 12. The keyboard 62 is positioned on the top surface 18 of the body 14 such that the keyboard 62 may be manipulated in the convention of playing music. The keyboard 62 is oriented to be substantially coextensive with the bottom side 26 of the body 14 and the keyboard 62 is electrically coupled to the control circuit 40.

A first set of switches 64 is provided and each of the first set of switches 64 is positioned on the top surface 18 of the guitar 12. Each of the first set of switches 64 is positioned to be substantially coextensive with the first lateral side 28 of the body 14. Each of the first set of switches 64 is electrically coupled to the control circuit 40. A second set of switches 66 is provided and each of the second set of switches 66 is positioned on the top surface 18 of the guitar 12. Each of the second set of switches 66 is positioned to be substantially coextensive with the second lateral side 30 of the body 14 and each of the second set of switches 66 is electrically coupled to the vocal modulator 44.

A microphone 68 is attached to the guitar 12 and the microphone 68 is positioned on the top surface 18 of the body 14 such that the microphone 68 may record a voice. The microphone 68 is electrically coupled to the control circuit 40 such that the electronic memory 46 may store the recorded voice. Each of the first switches is coupled to the microphone 68 through said control circuit. Each of the second set of switches 66 is manipulated to actuate the vocal modulator 44. Thus, the vocal modulator 44 modifies a sound of the recorded voice.

A plurality of speakers 70 is provided. Each of the speakers 70 is coupled to the guitar 12 and each of the speakers 70 is positioned on the top surface 18. Each of the speakers 70 is electrically coupled to the control circuit 40 such that each of the speakers 70 may emit the modified voice stored within the electronic memory 46.

In use, the guitar 12 and the keyboard 62 are manipulated in the convention of playing music. A musical pattern may be played on the keyboard 62 and the musical pattern may be stored within the electronic memory 46. The musical pattern stored in the electronic memory 46 may be played through the speakers 70 while the guitar 12 is manipulated thereby facilitating the musical pattern stored in the electronic memory 46 to accompany the guitar 12. Additionally, the microphone 68 may record a voice into the electronic memory 46 and the voice may be modified with the vocal modulator 44. The modified voice may be played over the speakers 70 while either the guitar 12 or the keyboard 62 is manipulated. The voice may be played over the speakers 70 without being modified by the vocal modulator 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A musical performance assembly combining elements of guitar performance with vocal recording and playback, said assembly comprising:

a guitar having a body and a neck;

a control circuit being attached to said guitar, said control circuit being positioned within said body;

a keyboard being attached to said guitar wherein said keyboard is configured to be manipulated in the convention of playing music, said keyboard extending across said guitar perpendicular to said neck of said guitar;

a first set of switches, each of said first set of switches being attached to said guitar, each of said first set of switches being electrically coupled to said control circuit;

a second set of switches, each of said second set of switches being attached to said guitar, each of said second set of switches being electrically coupled to said control circuit; and a microphone being attached to said guitar wherein said microphone is configured to record a voice, said microphone being electrically coupled to said control circuit, each of said first switches being manipulated to actuate said control circuit for controlling said microphone, each of said second set of switches being manipulated to actuate said control circuit wherein said control circuit is configured to modify a sound of the recorded voice.

2. The assembly according to claim 1, wherein said body has a top surface, a back surface and a peripheral edge extending between said top surface and said back surface, said peripheral edge having a top side, a bottom side, a first lateral side and a second lateral side, each of said first lateral side and said second lateral side having an angled portion, said angled portion of each of said first lateral side and said second lateral side angling inwardly between a point proximate a middle of said body and said top side.

3. The assembly according to claim 2, wherein said neck extends away from said top side, said neck having a distal end with respect to said body, said guitar including a plurality of strings extending along said neck and said top surface of said body wherein said strings are configured to be manipulated in the convention of playing music on the guitar.

4. The assembly according to claim 1, wherein said control circuit includes:

a processor;

a vocal modulator, said vocal modulator being electrically coupled to said processor; and an electronic memory being positioned within said guitar, said electronic memory being electrically coupled to said processor.

5. The assembly according to claim 4, wherein said control circuit further includes:

a switch being coupled to said back surface, said switch being electrically coupled to said processor;

a plurality of outputs, each of said outputs being positioned on said back surface of said guitar, each of said outputs being electrically coupled to said processor, each of said outputs being configured to be electrically coupled to an extrinsic electrical device; and a power supply being positioned within said body, said power supply being electrically coupled to said switch, said power supply comprising at least one battery.

6. The assembly according to claim 2, further comprising a pickup being attached to said guitar, said pickup being positioned on said top surface of said body, said pickup being positioned beneath said strings wherein said pickup converts vibration from said strings into an electrical signal, said pickup being electrically coupled to said control circuit.

7. The assembly according to claim 1, wherein:

said body has a top surface and a bottom side; and said keyboard is positioned on said top surface of said body said keyboard being oriented to be substantially coextensive with said bottom side of said body, said keyboard being electrically coupled to said control circuit.

8. The assembly according to claim 1, further comprising:

said guitar having a top surface; and a plurality of speakers, each of said speakers being coupled to said guitar, each of said speakers being positioned on said top surface, each of said speakers being electrically coupled to said control circuit wherein each of said speakers is configured to emit the modified voice stored within said electronic memory.

9. A musical performance assembly combining elements of guitar performance with vocal recording and playback, said assembly comprising:

a guitar having a body and a neck, said body having a top surface, a back surface and a peripheral edge extending between said top surface and said back surface, said peripheral edge having a top side, a bottom side, a first lateral side and a second lateral side, each of said first lateral side and said second lateral side having an angled portion, said angled portion of each of said first lateral side and said second lateral side angling inwardly between a point proximate a middle of said body and said top side, said neck extending away from said top side, said neck having a distal end with respect to said body, said guitar including a plurality of strings extending along said neck and said top surface of said body wherein said strings are configured to be manipulated in the convention of playing music on the guitar;

a control circuit being attached to said guitar, said control circuit being positioned within said body, said control circuit including:

a processor, a vocal modulator, said vocal modulator being electrically coupled to said processor, an electronic memory being positioned within said guitar, said electronic memory being electrically coupled to said processor, a switch being coupled to said back surface, said switch being electrically coupled to said processor, a plurality of outputs, each of said outputs being positioned on said back surface of said guitar, each of said outputs being electrically coupled to said processor, each of said outputs being configured to be electrically coupled to an extrinsic electrical device, and a power supply being positioned within said body, said power supply being electrically coupled to said switch, said power supply comprising at least one battery;

a pickup being attached to said guitar, said pickup being positioned on said top surface of said body, said pickup being positioned beneath said strings wherein said pickup converts vibration from said strings into an electrical signal, said pickup being electrically coupled to said control circuit;

a keyboard being attached to said guitar, said keyboard being positioned on said top surface of said body extending across said guitar perpendicular to said neck of said guitar wherein said keyboard is configured to be manipulated in the convention of playing music, said keyboard being oriented to be substantially coextensive with said bottom side of said body, said keyboard being electrically coupled to said control circuit;

a first set of switches, each of said first set of switches being positioned on said top surface of said guitar extending along said first lateral side of said body, each of said first set of switches being positioned to be substantially coextensive with said first lateral side of said body, each of said first set of switches being electrically coupled to said control circuit;

a second set of switches, each of said second set of switches being positioned on said top surface of said guitar extending along said second lateral side of said body, each of said second set of switches being positioned to be substantially coextensive with said second lateral side of said body, each of said second set of switches being electrically coupled to said vocal modulator;

a microphone being attached to said guitar, said microphone being positioned on said top surface of said body wherein said microphone is configured to record a voice, said microphone being electrically coupled to said control circuit wherein said electronic memory is configured to store the voice, each of said first switches being manipulated to actuate said control circuit for controlling said microphone, each of said second set of switches being manipulated to actuate said vocal modulator wherein said vocal modulator is configured to modify a sound of the recorded voice; and a plurality of speakers, each of said speakers being coupled to said guitar, each of said speakers being positioned on said top surface, each of said speakers being electrically coupled to said control circuit wherein each of said speakers is configured to emit the modified voice stored within said electronic memory.

* * * * *